US005924796A

United States Patent [19]

Derby

[11] Patent Number: 5,924,796

[45] Date of Patent: Jul. 20, 1999

[54] ONE PIECE FLEXIBLE INTERMEDIATE BULK CONTAINER AND PROCESS FOR MANUFACTURING SAME

[75] Inventor: Norwin C. Derby, Dallas, Tex.

[73] Assignee: Super Sack Manufacturing Corp., Dallas, Tex.

[21] Appl. No.: 08/792,907

[22] Filed: Feb. 6, 1997

[51] Int. Cl.[6] ..... B65D 33/14

[52] U.S. Cl. ..... 383/8; 383/41; 383/67; 493/235; 493/226

[58] Field of Search ..... 383/24, 8, 41, 383/67, 37; 493/235, 236, 239, 226

[56] References Cited

U.S. PATENT DOCUMENTS

| | | | |
|---|---|---|---|
| 4,010,784 | 3/1977 | Nattrass | 383/24 |
| 4,113,146 | 9/1978 | Williamson | 222/105 |
| 4,143,796 | 3/1979 | Williamson et al. | 222/185 |
| 4,194,652 | 3/1980 | Williamson et al. | 222/185 |
| 4,224,970 | 9/1980 | Williamson et al. | 150/1 |
| 4,312,392 | 1/1982 | Sekiguchi | 383/8 |
| 4,457,456 | 7/1984 | Derby et al. | 222/105 |
| 4,479,243 | 10/1984 | Derby et al. | 383/24 |
| 4,480,766 | 11/1984 | Platt | 383/24 |
| 4,524,457 | 6/1985 | Marino | 383/24 |
| 4,573,204 | 2/1986 | Polett | 383/41 |
| 4,759,473 | 7/1988 | Derby et al. | 222/105 |
| 4,811,419 | 3/1989 | Derby | 383/67 |
| 4,859,082 | 8/1989 | Llorens et al. | 383/37 |
| 5,076,710 | 12/1991 | Derby | 383/22 |
| 5,104,236 | 4/1992 | LaFleur | 383/41 |
| 5,158,367 | 10/1992 | Derby | 373/17 |
| 5,165,802 | 11/1992 | Derby | 383/22 |
| 5,203,633 | 4/1993 | Derby | 383/17 |
| 5,244,281 | 9/1993 | Williamson et al. | 383/24 |

FOREIGN PATENT DOCUMENTS

| | | | |
|---|---|---|---|
| 5270547 | 10/1993 | Japan | 383/41 |
| 2128585 | 5/1984 | United Kingdom | 383/8 |
| 2016438 | 10/1992 | WIPO | 383/24 |

*Primary Examiner*—Stephen P. Garbe
*Attorney, Agent, or Firm*—Michael A. O'Neil

[57] ABSTRACT

A process of manufacturing a bulk bag begins with a length of tubular woven polypropylene material which is cut along first transversely extending lines 64 to form the upper edges of lift sleeve portions 76, cut along longitudinally extending lines 66 to form the side edges of the lift sleeve portions 76, and cut along substantially transversely extending lines 68 situated at the midpoint of the lines 66 to form opposed top wall halves 72 and opposed bottom wall halves 74. The top wall halves and the bottom wall halves are then sewn together along sew lines 82 and 84, respectively. Sidewalls 70' are joined to the bottom wall halves 74 along sew lines 86, and the top wall halves 72 are joined to the sidewalls 70' along sew lines 88. The lift sleeve portions 76 may be configured to provide lift sleeve, lift rope, or single point lift construction. The top and bottom walls may be provided with a fill chute and discharge chute, respectively.

10 Claims, 3 Drawing Sheets

ONE PIECE FLEXIBLE INTERMEDIATE BULK CONTAINER AND PROCESS FOR MANUFACTURING SAME

TECHNICAL FIELD

This invention relates to flexible intermediate bulk containers and, more particularly, to bulk containers constructed from a single piece of tubular woven fabric and process for manufacturing the same.

BACKGROUND AND SUMMARY OF THE INVENTION

Historically, flexible intermediate bulk containers (bulk bags) have been used for receiving, storing, transporting and discharging flowable materials of all types. Bulk bags are typically constructed in a square, vertically rectangular or circular shape with lift straps attached to each of the uppermost corners of the square, rectangle or circle.

By way of example, flexible intermediate bulk containers are used for handling granular, liquid or powder (flowable) materials such as chemicals, minerals, fertilizers, foodstuffs, grains and agricultural products. The advantages of such receptacles include relatively low weight, reduced cost, versatility and, in the case of reusable receptacles, low return freight costs.

At the present time most bulk bags are manufactured from woven polypropylene fabric. Typically, such containers are constructed by stitching or sewing together two or more sidewalls and a bottom portion. Optionally, a top portion, lift straps or other structural support can be added to this basic construction. The traditional method of securing the seams of the several portions of the container includes sewing or stitching.

The instant invention comprises a method of construction of a container from a single piece of woven tubular fabric comprising side, top and bottom walls of which are quickly, easily and inexpensively formed from the container.

BRIEF DESCRIPTION OF THE DRAWINGS

A more complete understanding of the invention may be had by reference to the following Detailed Description when taken in conjunction with the accompanying Drawings in which.

DETAILED DESCRIPTION

Figure 1A:
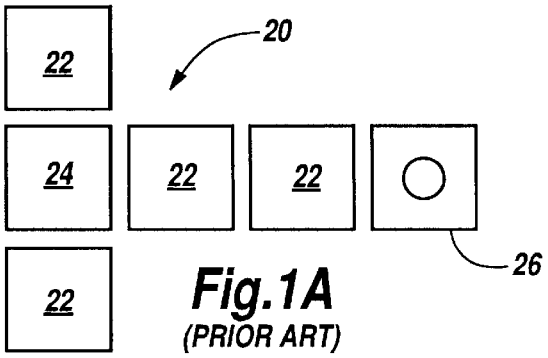
Fig.1A (PRIOR ART)
FIG. 1A is an exploded view of a first prior art bulk bag construction.
Figure 1B:
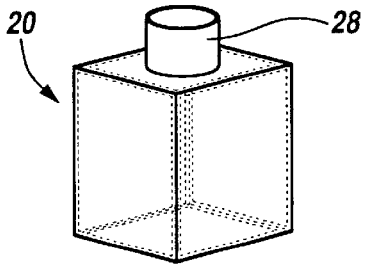
Fig.1B (PRIOR ART)
FIG. 1B is an assembled view of the prior art bulk bag of FIG. 1A.

Referring now to the Drawings and, particularly, to FIGS. 1A and 1B thereof, there is shown a first prior art bulk bag 20. The bulk bag 20 comprises four side panels 22, a bottom panel 24 and a top panel 26. The panels 22, 24 and 26 are sewn one to the other along all four of their respective edges to form the bulk bag 20. As is best shown in FIG. 1B, the resulting bulk bag is in the form of a cube. As is further illustrated in FIG. 1B and as is well known in the art, the bulk bag 20 may be provided with a top chute 28, a similar bottom chute (not shown), lift loops (not shown), lift sleeves (not shown), etc.

Figure 2A:
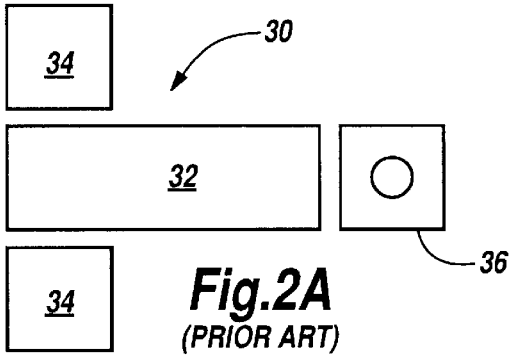
Fig.2A (PRIOR ART)
FIG. 2A is an exploded view of a second prior art bulk bag construction.
Figure 2B:
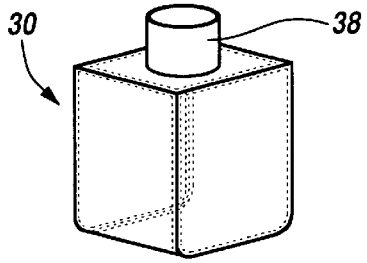
Fig.2B (PRIOR ART)
FIG. 2B is an assembled view of the prior art bulk bag of FIG. 2A.

Referring to FIGS. 2A and 2B, there is shown a second prior art bulk bag 30 of the type commonly referred to as a U-panel bag. The bulk bag 30 comprises an elongate U-panel 32 which forms the bottom and two sides of the bulk bag 30, two side panels 34 and a top panel 36. As is illustrated in FIG. 2B, the panels 32, 34 and 36 are sewn together along all four of their respective edges to form a bulk bag which takes the form of a cube. As is further illustrated in FIG. 2B and as is well known in the art, the bulk bag 30 may be provided with a top chute 38, a similar bottom chute (not shown), lift loops (not shown), lift sleeves (not shown), etc.

Figure 3A:
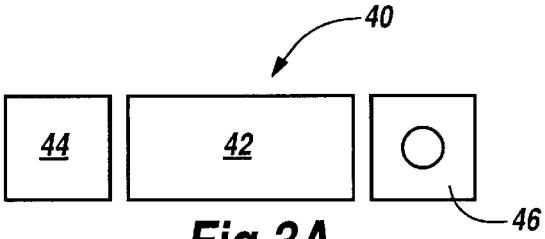
Fig.3A (PRIOR ART)
FIG. 3A is an exploded view of a third prior art bulk bag construction.
Figure 3B:
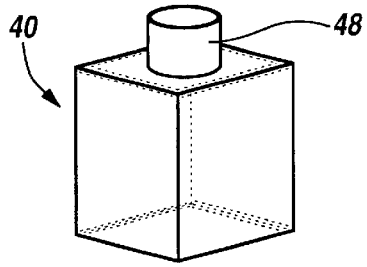
Fig.3B (PRIOR ART)
FIG. 3B is an assembled view of the prior art bulk bag of FIG. 3A.

Referring to FIGS. 3A and 3B, there is shown a third prior art bulk bag 40. The bulk bag 40 comprises a tubular construction 42 which is typically manufactured on a circular loom. The bulk bag 40 further comprises a bottom panel 44 and a top panel 46. In the construction of the bulk bag 40, the tube 42 is joined to the bottom panel 44 and the top panel 46 along the entire peripheries thereof to form the completed bulk bag. Those skilled in the art will appreciate that although the bottom panel 44 and the top panel 46 are illustrated in FIG. 3A as being rectangular in shape, the top panel 46 and bottom panel 44 of the bulk bag 40 need not be of any particular shape, and quite frequently are circular in configuration.

FIG. 3B illustrates the completed bulk bag 40. The bulk bag 40 may be provided with a top chute 48, a similar bottom chute (not shown), lift loops (not shown), lift sleeves (not shown), etc.

Figure 4A:
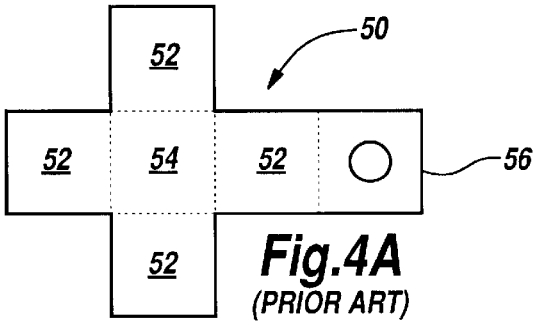
Fig.4A (PRIOR ART)
FIG. 4A is an exploded view of a fourth prior art bulk bag construction.
Figure 4B:
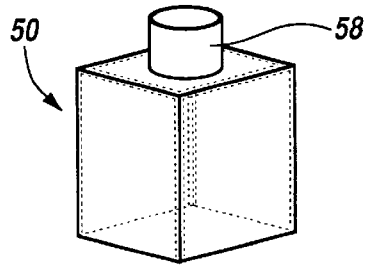
Fig.4B (PRIOR ART)
FIG. 4B is an assembled view of the prior art bulk bag of FIG. 4A.

Referring to FIGS. 4A and 4B, there is shown a fourth prior art bag 50. The bulk bag 50 is formed from a single piece of material which may be considered as being segregated into side panel portions 52, a bottom panel portion 54 and a top panel portion 56. The bulk bag 50 is completed by joining the side panel portions 54 and the top panel portion 56 one to the other along their respective peripheries, preferably by sewing.

As is illustrated in FIG. 4B, the completed bulk bag 50 is in the form of a cube. The bulk bag 50 may be provided with a top chute 58, a similar bottom chute (not shown), lift loops (not shown), lift sleeves (not shown), etc.

Figure 5:
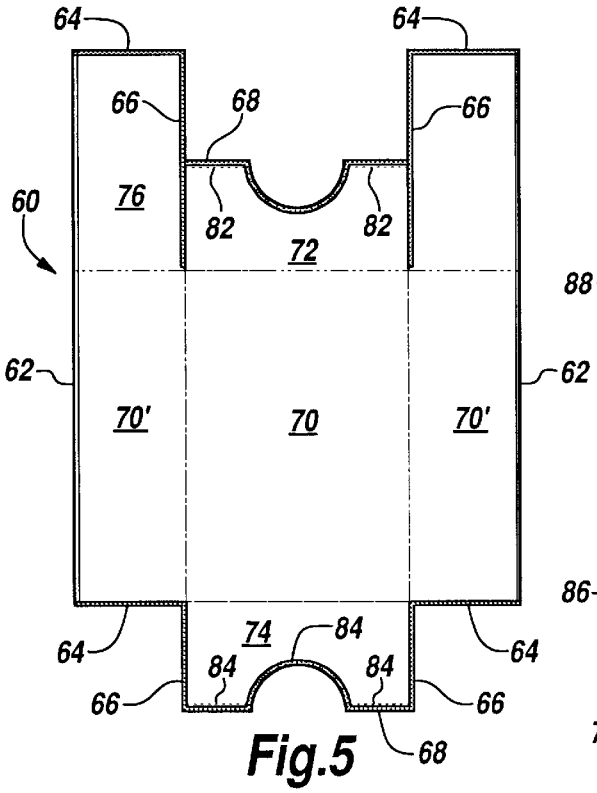
FIG. 5 is an illustration of initial steps in the process of manufacturing the bulk bag of the present invention.

Referring now to FIG. 5, there is shown the first steps of a process for manufacturing a bulk bag 60 comprising the present invention. The bulk bag 60 is preferably formed from a length of tubular material, preferably woven polypropylene material. The length of tubular material comprising the bulk bag 60 may conveniently be formed on a circular loom; however, it will be understood that other methods for manufacturing the length of tubular material may be employed in the practice of the invention, if desired.

The process for manufacturing the bulk bag 60 of the present invention begins by laying the length of tubular material flat. Thus, the length of tubular material comprises two layers, one positioned on top of the other, which are joined together along lines 62 comprising folds in the fabric of the tubular material. Next, the length of tubular material is laser cut along transverse lines 64, longitudinal lines 66 and substantially transverse lines 68 (located at the midpoints of lines 66) to form the configuration illustrated in FIG. 5. Those skilled in the art will appreciate the fact that by making the cuts 64, 66 and 68, the length of tubular material is automatically formed into successive blanks, each comprising one bulk bag 60 incorporating the present invention.

Figure 6:
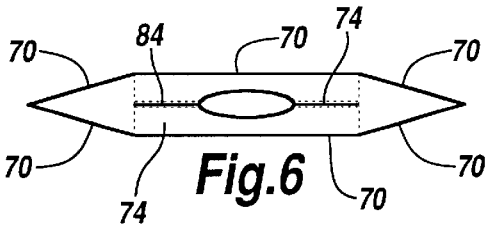
FIG. 6 is an illustration of later steps in the process of manufacturing the bulk bag of the present invention.

The foregoing procedure forms a blank for the bulk bag 60 comprising sidewall portions 70 and 70', unconnected top wall halves 72, unconnected bottom wall halves 74 and lift sleeve portions 76. The next step in the fabrication of the bulk bag 60 comprises joining the top wall halves one to the other. This is preferably accomplished by sewing or stitching the top wall halves together along sew line 82. Likewise, the bottom wall halves 74 are joined one to the other preferably by sewing or stitching the bottom wall halves 74 one to the other along sew line 84. The result of this procedure is illustrated in FIG. 6 which shows the bottom wall halves 74 joined together along the sew lines 84 to form the bottom wall of the bulk bag 60.

Figure 7:
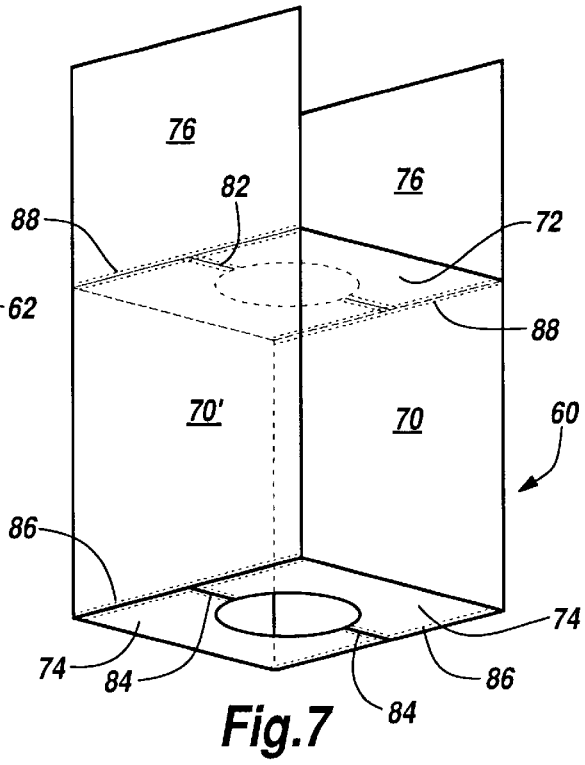
FIG. 7 is an illustration of still later steps in the process of manufacturing the bulk bag of the present invention.

The next steps of the process for manufacturing the bulk bag 60 of the present invention are illustrated in FIG. 7. The blank comprising the bulk bag 60 is manipulated into a rectangular configuration whereupon the peripheral edges of the side panels 70' are joined to the peripheral edges of the bottom wall halves 74, preferably by sewing or stitching along sew lines 86. Likewise, the top wall halves 72 are joined to the sidewalls 70' by sewing or stitching along sew lines 88.

Figure 8:
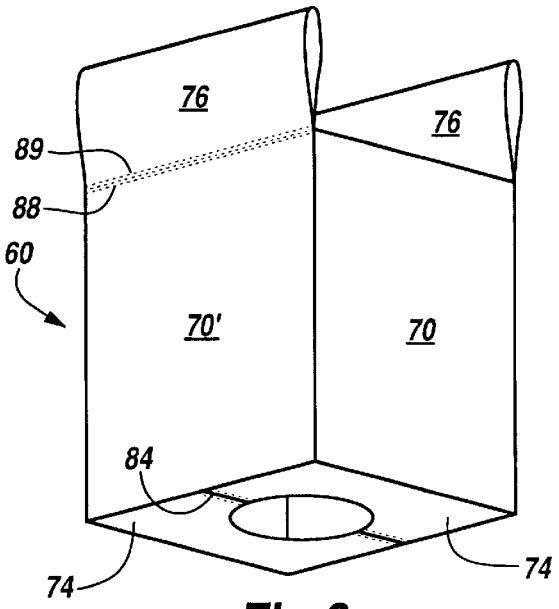
FIGS. 8 and 9 are illustrations of the final steps in the process of manufacturing a first variation of the bulk bag of the present invention.
Figure 9:
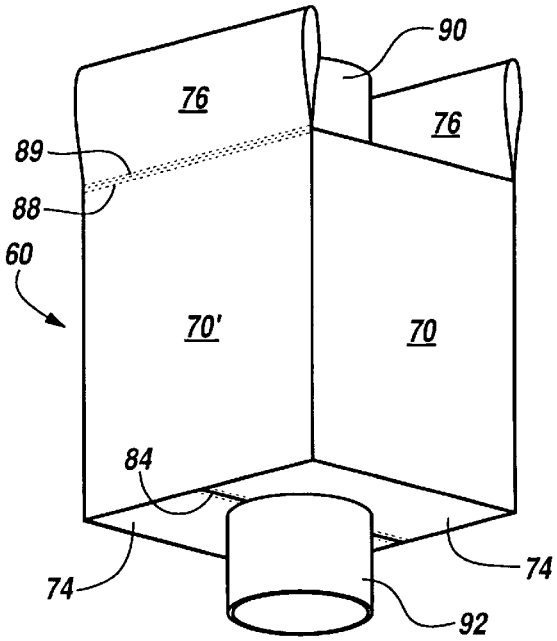

FIGS. 8 and 9 illustrate the completion of the bulk bag 60 to form a first variation thereof. The lift sleeve portions 76 are folded, and the distal ends thereof are secured by sew lines 89 adjacent to the sew lines 88, preferably by sewing or stitching. In this manner there is formed lift sleeves of the type well known in the bulk bag art which are adapted to receive forklift tines to facilitate the lifting and transport of the bulk bag 60 and the contents thereof. In actual practice, the distal ends of the lift sleeve portions 76 may be secured in place at the same time that the top wall halves 72 are joined to the sidewalls 70' by means of two identical sewing or stitching operations, one on each side of the bulk bag 60.

As is shown in FIG. 9, the bulk bag 60 may be completed by the installation of a top chute 90, also referred to in the art as a fill chute. The bulk bag 60 may also be provided with a bottom chute 92, also referred to in the art as a discharge chute. Those skilled in the art will appreciate the fact that the top of the bulk bag 60 may be configured to provide a duffel top or skirt top configuration comprising the entirety of the top of the bag. Alternatively, the bulk bag 60 may be provided with an open top configuration. Likewise, the bottom chute 92 may be replaced with a full open bottom configuration also known as a full discharge bottom. Alternatively, the discharge chute 92 may be omitted entirely in which case the bottom of the bag 60 comprises a plain bottom, also known as a solid bottom.

Figure 10:
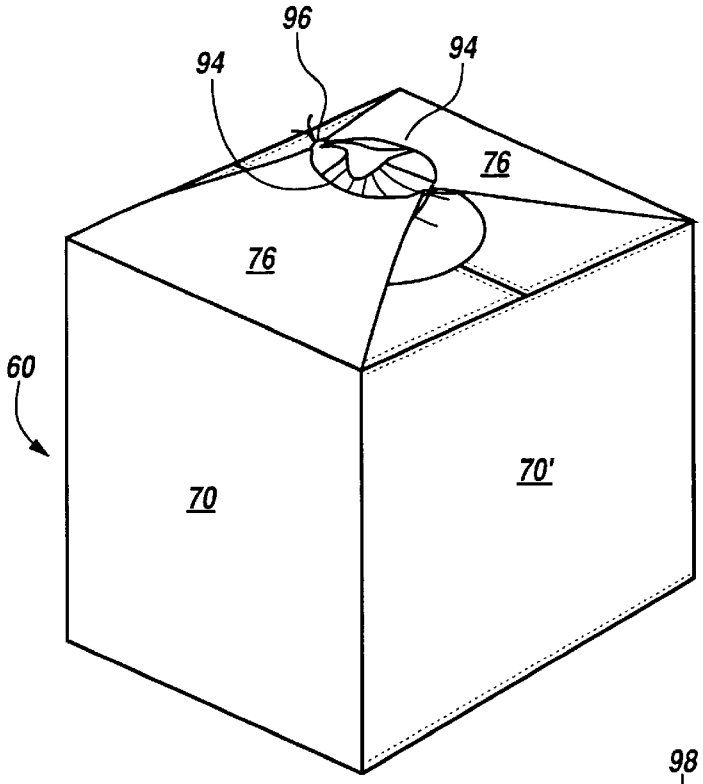
FIG. 10 is an illustration of a first variation of the process of manufacturing the bulk bag of the present invention.

FIG. 10 illustrates a bulk bag 60 comprising a second variation of the present invention. Rather than being folded over and joined to form lift sleeves, the distal ends of the lift sleeve portion 76 may be folded over and joined along sew lines 94 to form passageways for receiving a rope 96. The rope 96 may then be engaged by a hook or other conventional lifting apparatus to facilitate lifting and transport of the bulk bag 60.

Figure 11:
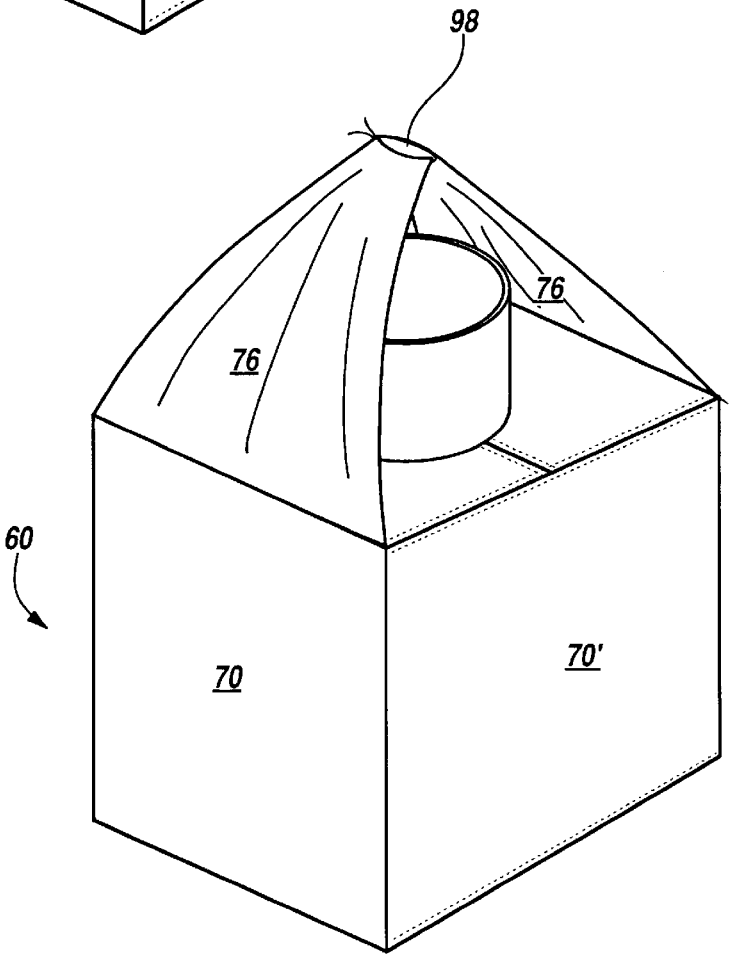
FIG. 11 is an illustration of a second variation of the process of manufacturing the bulk bag of the present invention.

FIG. 11 illustrates a third variation of the bulk bag 60 of the present invention. In accordance with the third variation, the distal ends of the lift sleeve portion 76 are gathered together and joined at upper ends 98 by means of sewing, stitching or other conventional means to provide a bulk bag having a single point lift configuration. Again, the variation of the bulk bag 60 illustrated in FIG. 11 is adapted to be lifted and transported by means of a hook or other conventional bulk bag lifting and transporting apparatus.

Although preferred embodiments have been illustrated in the drawings and described hereinabove, it will be understood that the invention is not limited to the embodiments disclosed, but is capable of numerous rearrangements, modifications and substitutions of parts and elements without departing from the spirit of the invention.

I claim:

1. A flexible intermediate bulk container comprising:

A. a tubular blank formed from a fabric tube initially comprising:
   i. a side wall,
   ii. a top end defined by transversely extending cut lines that intersect longitudinally extending cut lines to form opposed lift sleeve portions and a second transversely extending cut line that intersects the second longitudinally extending cut lines to form opposed top wall halves, and
   iii. a bottom end defined by transversely extending cut line that intersect longitudinally extending cut lines to form opposed bottom wall halves;

B. a top formed by folding the opposed top wall halves of the tubular wall toward each other, securing the distal ends to each other, and securing the edges of the opposed top wall halves to the sidewall;

C. a bottom formed by folding the opposed bottom wall halves of the tubular wall toward each other, securing the distal ends to each other, and securing the edges of the opposed bottom wall halves to the sidewall; and D. a single point lift formed by securing the distal ends of the opposed lift sleeve portions to one another, including:
   a pocket formed at the distal end of each opposed lift sleeve; and
   an elongate continuous member inserted through the pocket of each said lift sleeves thereby securing said opposed lift to one another.

2. A method of manufacturing a flexible intermediate bulk container constructed from a single piece tubular blank, said method comprising:

providing a fabric tube including;

cutting a top end of the fabric tube along a pair of first transversely extending cut lines;

cutting a second pair of longitudinally extending cut lines that intersect the first transversely extending cut lines to form opposed lift sleeve portions;

cutting a second transversely extending cut line that intersects the mid-portion of each of the longitudinally extending cut lines to form opposed top wall halves;

cutting a bottom end of the fabric tube along a pair of third transversely extending cut lines;

cutting a second pair of longitudinally extending cut lines that intersect the third transversely extending cut lines to form opposed bottom wall halves;

forming lift sleeves by folding the lift sleeve portions at the top end inwardly and securing the distal ends of the lift sleeve portions to the proximal ends;

forming a top by folding the opposed top wall halves of the bulk bag blank toward each other, securing the distal ends to each other, and securing the edges of the opposed top wall halves to the sidewalls;

the steps of securing the distal ends of the lift sleeves to the maximal ends thereof and securing the edges of the top wall halves to the sidewalls being carried out simultaneously; and forming a bottom by folding the opposed bottom wall halves of the bulk bag blank toward each other, securing the distal ends to each other, and securing the edges of the opposed bottom wall halves to the sidewall.

3. The method of manufacturing a flexible intermediate bulk container of claim 2 further including the step of continuously weaving a fabric tube for forming the tubular blank.

4. The method of manufacturing a flexible intermediate bulk container of claim 2 further including the steps of:

cutting a half circle in the third transversely extending cut line of the top end of the tubular blank; and inserting and securing a fill chute in said half circle.

5. The method of manufacturing a flexible intermediate bulk container of claim 2 further including the steps of:

cutting a half circle in the fourth transversely extending cut line of the bottom end of the tubular blank; and inserting and securing a discharge chute in said half circle.

6. A method of manufacturing a flexible intermediate bulk container constructed from a single piece tubular blank, said method comprising:

providing a fabric tube including;

cutting a top end of the fabric tube along a pair of first transversely extending cut lines;

cutting a second pair of longitudinally extending cut lines that intersect the first transversely extending cut lines to form opposed lift sleeve portions;

cutting a second transversely extending cut line that intersects the mid-portion of each of the longitudinally extending cut lines to form opposed top wall halves;

cutting a bottom end of the fabric tube along a pair of third transversely extending cut lines;

cutting a second pair of longitudinally extending cut lines that intersect the third transversely extending cut lines to form opposed bottom wall halves;

forming a single point lift by securing the distal ends of the opposed lift sleeve portions to one another;

forming a top by folding the opposed top wall halves of the bulk bag blank toward each other, securing the distal ends to each other, and securing the edges of the opposed top wall halves to the sidewall; and forming a bottom by folding the opposed bottom wall halves of the bulk bag blank toward each other, securing the distal ends to each other, and securing the edges of the opposed bottom wall halves to the sidewall.

7. A method of manufacturing a flexible intermediate bulk container constructed from a single piece tubular blank, said method comprising:

providing a fabric tube including;

cutting a top end of the fabric tube along a pair of first transversely extending cut lines;

cutting a second pair of longitudinally extending cut lines that intersect the first transversely extending cut lines to form opposed lift sleeve portions;

cutting a second transversely extending cut line that intersects the mid-portion of each of the longitudinally extending cut lines to form opposed top wall halves;

cutting a bottom end of the fabric tube along a pair of third transversely extending cut lines;

cutting a second pair of longitudinally extending cut lines that intersect the third transversely extending cut lines to form opposed bottom wall halves;

forming a single point lift by securing the distal ends of the opposed lift sleeve portions to one another;

forming a top by folding the opposed top wall halves of the bulk bag blank toward each other, securing the distal ends to each other, and securing the edges of the opposed top wall halves to the sidewall;

forming a bottom by folding the opposed bottom wall halves of the bulk bag blank toward each other, securing the distal ends to each other, and securing the edges of the opposed bottom wall halves to the sidewall;

forming a pocket in the distal end of each opposed lift sleeve; and inserting a continuous elongate member through the pocket of each of said lift sleeves thereby securing said opposed lift sleeves to one another.

8. The method of manufacturing a flexible intermediate bulk container of claim 7 further including the step of continuously weaving a fabric tube for forming the tubular blank.

9. The method of manufacturing a flexible intermediate bulk container of claim 7 further including the steps of:

cutting a half circle in the third transversely extending cut line of the top end of the tubular blank; and inserting and securing a fill chute in said half circle.

10. The method of manufacturing a flexible intermediate bulk container of claim 7 further including the steps of:

cutting a half circle in the fourth transversely extending cut line of the bottom end of the tubular blank; and inserting and securing a discharge chute in said half circle.

* * * * *